US006923017B2

(12) United States Patent
Dais et al.

(10) Patent No.: US 6,923,017 B2
(45) Date of Patent: Aug. 2, 2005

(54) COOLING CONTAINER HAVING A COOLANT AND PRESSURE RELIEF APPARATUS

(75) Inventors: Brian C. Dais, Howell, MI (US); Angela M. Johnson, Sun Prairie, WI (US); Lewis D. Lee, Evansville, WI (US); Peter Schroepfer, Madison, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 10/073,559

(22) Filed: Feb. 11, 2002

(65) Prior Publication Data

US 2003/0150238 A1 Aug. 14, 2003

(51) Int. Cl.[7] ..... F25D 3/08

(52) U.S. Cl. ..... 62/457.6; 62/371; 62/530

(58) Field of Search ..... 62/457.6, 457.2, 62/457.3, 371, 530; 137/59, 68.19, 68.23, 68.27, 68.28, 67

(56) References Cited

U.S. PATENT DOCUMENTS

| | | | | |
|---|---|---|---|---|
| 1,249,096 A | 12/1917 | Hulme | | |
| 3,111,240 A | 11/1963 | Whitton, Jr. | ..... | 220/67 |
| 3,460,711 A | 8/1969 | Al-Roy | ..... | 220/60 |
| 3,622,016 A | 11/1971 | Bozek | ..... | 214/6 B |
| 3,692,208 A | 9/1972 | Croyle et al. | ..... | 220/24.5 |
| 4,027,776 A | 6/1977 | Douglas | ..... | 220/281 |

(Continued)

FOREIGN PATENT DOCUMENTS

| | | | | |
|---|---|---|---|---|
| JP | 354013046 A | * | 1/1979 | ..... 137/68.19 |
| WO | WO 93/24797 | | 12/1993 | |
| WO | WO93-24797 A | * | 12/1993 | |
| WO | WO 99/32373 | | 7/1999 | |

OTHER PUBLICATIONS

PCT International Search Report dated Jun. 24, 2003, Appl. No. PCT/US03/03954.

PCT Written Opinion dated Aug. 29, 2003; PCT/US 03/03958.

First concept page entitled "Introducing New Ziploc Cold-Loc Containers: Reusable containers that keep your food cold for hours."

Second concept page entitled "Introducing New Ziploc ColdLoc Containers: Reusable containers that keep your food cold for hours."

Third concept page entitled "Introducing New Ziploc Cold-Loc Containers: Reusable containers that keep your food cold for hours."

Fourth concept page entitled "Introducing New Ziploc Cold-Loc Containers: Reusable containers that keep your food cold for hours."

Fifth concept page entitled "Introducing New Ziploc Cold-Loc Containers: Reusable containers that keep your food cold for hours."

Pair of digital photographs (i.e., perspective and cross–sectional view) of a first sample container.

Pair of digital photographs (i.e., perspective and cross–sectional view) of a second sample container.

Pair of digital photographs (i.e., perspective and cross–sectional view) of a third sample container.

Tenneco Packaging (of Evanston, Illinois), Specialty Products Catalog, Summer of 1996.

Photographs of Central Fine Pack Container, Central Fine Pack, Inc. of Fort Wayne, Indiana (no date).

*Primary Examiner*—William C. Doerrler

(57) ABSTRACT

A container comprises a first container portion and a second container portion joined to the first container portion to define a sealed cavity therebetween. A coolant is disposed within the sealed cavity. The container further comprises a pressure relief apparatus operable to limit pressure in the sealed cavity.

32 Claims, 12 Drawing Sheets

U.S. PATENT DOCUMENTS 4,262,815 A 4/1981 Klein ..... 220/273
4,341,324 A 7/1982 Ramirez ..... 220/306
4,349,119 A 9/1982 Letica ..... 220/306
4,387,828 A 6/1983 Yates, Jr. ..... 220/284
4,416,388 A * 11/1983 Mulawski ..... 220/203.08
4,426,014 A 1/1984 Coltman, Jr. ..... 220/307
4,738,372 A * 4/1988 Jernberg ..... 220/89.2
4,747,510 A 5/1988 Mack ..... 220/270
4,765,506 A 8/1988 Fishman et al. ..... 220/355
4,844,263 A 7/1989 Hadtke ..... 206/508
4,917,261 A 4/1990 Borst ..... 220/324
4,974,742 A 12/1990 Farrell et al. ..... 220/94
4,986,438 A 1/1991 Borst ..... 220/315
5,079,932 A * 1/1992 Siegel ..... 62/293
5,271,244 A * 12/1993 Staggs ..... 62/457.3
5,293,997 A 3/1994 Hustad et al. ..... 206/467
5,345,784 A * 9/1994 Bazemore et al. ..... 62/371
5,361,604 A 11/1994 Pier et al. ..... 62/457.4
5,390,797 A 2/1995 Smalley et al. ..... 206/542
5,411,158 A * 5/1995 Kays et al. ..... 220/89.2
5,460,286 A 10/1995 Rush et al. ..... 220/306
5,489,036 A 2/1996 Arkins ..... 215/343
5,518,133 A 5/1996 Hayes et al. ..... 220/306
5,542,234 A 8/1996 Wyslotsky et al. ..... 53/433
5,718,124 A * 2/1998 Senecal ..... 62/457.6
5,758,793 A 6/1998 Forsyth et al. ..... 220/270
5,806,710 A 9/1998 Shiffer et al. ..... 220/785
5,865,037 A * 2/1999 Bostic ..... 62/371
5,887,437 A 3/1999 Maxim ..... 62/4
5,943,875 A * 8/1999 Hymes ..... 62/294
5,972,292 A 10/1999 DeMeo ..... 422/25
6,062,040 A * 5/2000 Bostic et al. ..... 62/530
6,068,898 A 5/2000 Oyama ..... 428/35.2
6,151,911 A * 11/2000 Dando et al. ..... 62/457.3
6,209,343 B1 * 4/2001 Owen ..... 62/457.2
6,209,344 B1 * 4/2001 Mahajan ..... 62/457.3
6,213,302 B1 4/2001 Sanders et al. ..... 206/521.1
6,216,905 B1 4/2001 Mogard et al. ..... 220/257
6,217,136 B1 4/2001 Dorfman et al. ..... 312/135
6,230,924 B1 5/2001 Weiss et al. ..... 220/713
6,257,434 B1 7/2001 Lizzio ..... 220/4.23
6,260,729 B1 7/2001 Mitchell et al. ..... 220/287
6,260,731 B1 7/2001 Cummings ..... 220/717
6,273,258 B1 8/2001 Piacenza ..... 206/503
6,276,555 B1 8/2001 Edwards ..... 220/572
6,283,298 B1 9/2001 Seidler ..... 206/581
6,325,234 B1 12/2001 Legaspi ..... 220/367.1
6,343,709 B1 2/2002 DeForrest et al. ..... 220/327
6,349,820 B1 2/2002 Kelley et al. ..... 206/223
6,364,112 B1 4/2002 Pitschka ..... 206/460
6,364,152 B1 4/2002 Poslinski et al. ..... 220/788
6,607,003 B1 * 8/2003 Wilson ..... 137/68.23

* cited by examiner

COOLING CONTAINER HAVING A COOLANT AND PRESSURE RELIEF APPARATUS

TECHNICAL FIELD

The present invention relates generally to containers and more particularly to a cooling container having a coolant and pressure relief apparatus.

BACKGROUND ART

Cooling containers are used to contain a variety of products and maintain such products at a reduced temperature relative to ambient temperature for a prolonged period of time. An example of a cooling container is disclosed in E. L. Smith U.S. Pat. No. 2,526,165, which describes (in connection with FIG. 6 therein) a container having an outer bowl that surrounds an inner bowl wherein the bowls are hermetically sealed to define a chamber therebetween. A suitable refrigerant liquid such as water is disposed within the chamber. A user places the container into a household freezer for a long enough period of time to freeze the liquid. Thereafter, the user takes the container out of the freezer and may place a product, such as a perishable food item, within the container. The refrigerant liquid is capable of maintaining the food item placed in the container at a temperature below room temperature for a relatively long period of time.

Some prior art containers using a coolant or refrigerant within a cavity have included air space within the cavity to allow for expansion of the refrigerant upon freezing. Allowing for such expansion prevents such containers from rupturing. Another strategy to prevent such rupture of a cooling container is disclosed in Hilado U.S. Pat. No. 4,485,636 where the bottom of the cavity is formed by a resilient diaphragm. The diaphragm allows for expansion of the refrigerant by compressing in response to the expanding refrigerant, thereby increasing the volume of the cavity and preventing the walls of the container from breaking as a result of the expanding refrigerant.

While numerous prior art containers deal with pressure increases within a cavity due to expansion of refrigerant upon freezing, no known attempts have been made for handling pressure increases resulting from increased heat. It is possible that if a user were to place a prior art container within a microwave oven, sufficient heat and pressure would develop within the sealed cavity to rupture the walls of the container.

SUMMARY OF THE INVENTION

In accordance with one aspect of the present invention, a container comprises a first container portion and a second container portion joined to the first container portion to define a sealed cavity therebetween. A coolant is disposed within the sealed cavity. The container further comprises a pressure relief apparatus operable to limit pressure in the sealed cavity.

According to a further aspect of the present invention, a container comprises a first container portion and a second container portion joined to the first container portion to define a sealed cavity therebetween. A coolant is disposed within the cavity. A joined section joins the first and second container portions. The joined section is operable to limit pressure within the cavity.

A further alternative aspect of the present invention comprehends a container comprising a first container portion having a first wall, a base portion and a first rim. A second container portion has a second wall and a second rim. The second rim is joined to the first rim, thereby defining a cavity between the container portions. A gel is disposed within the cavity. A first raised portion, integral with the second wall, joins the second wall to the base portion and is rupturable in response to a first elevated pressure. A second raised portion, also integral with the second wall, also joins the second wall to the base portion and is rupturable at a second elevated pressure greater than the first elevated pressure.

DESCRIPTION OF THE PREFERRED EMBODIMENTS

Figure 1:
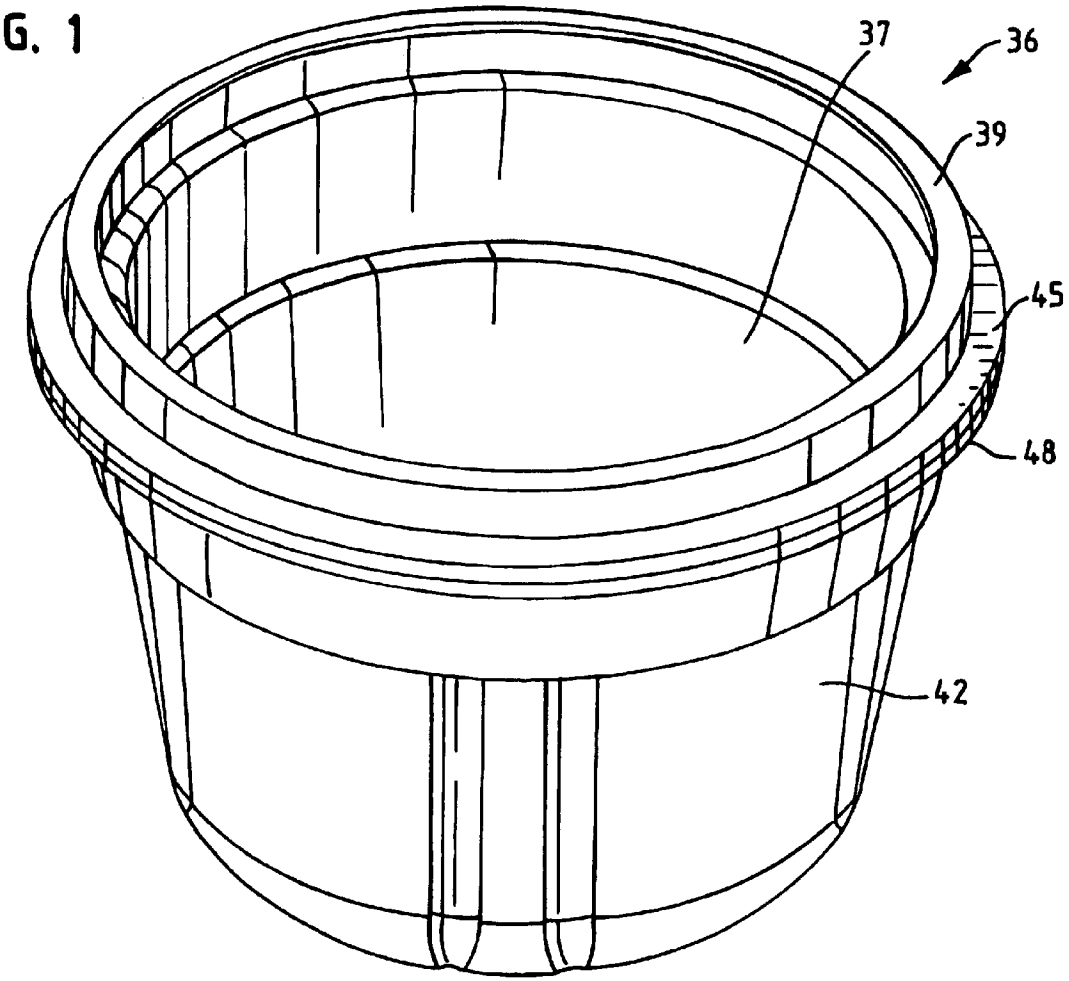
FIG. 1 is an isometric view of a container according to the present invention looking down from above.
Figure 2:
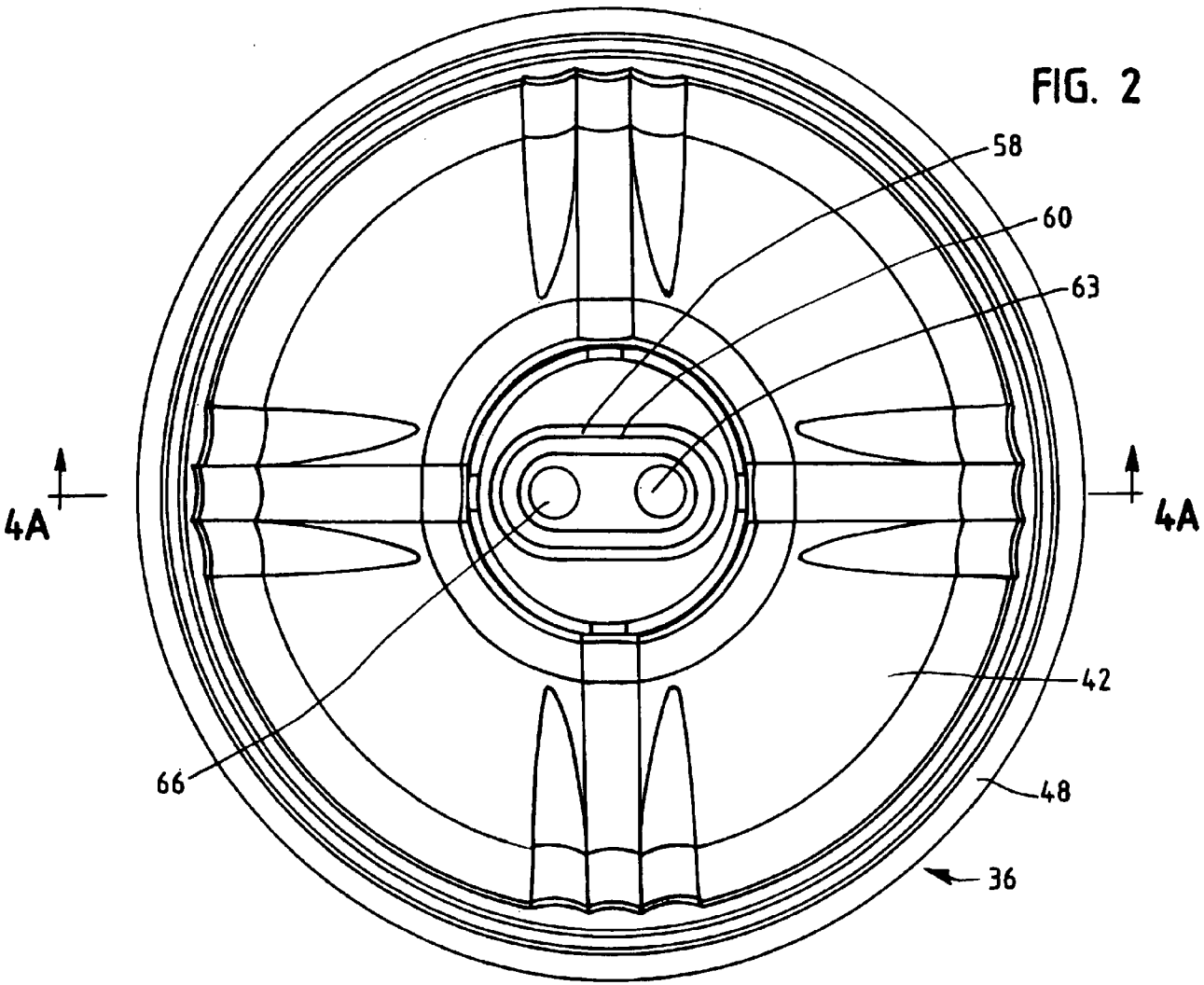
FIG. 2 is a bottom view of the container of FIG. 1.
Figure 4A:
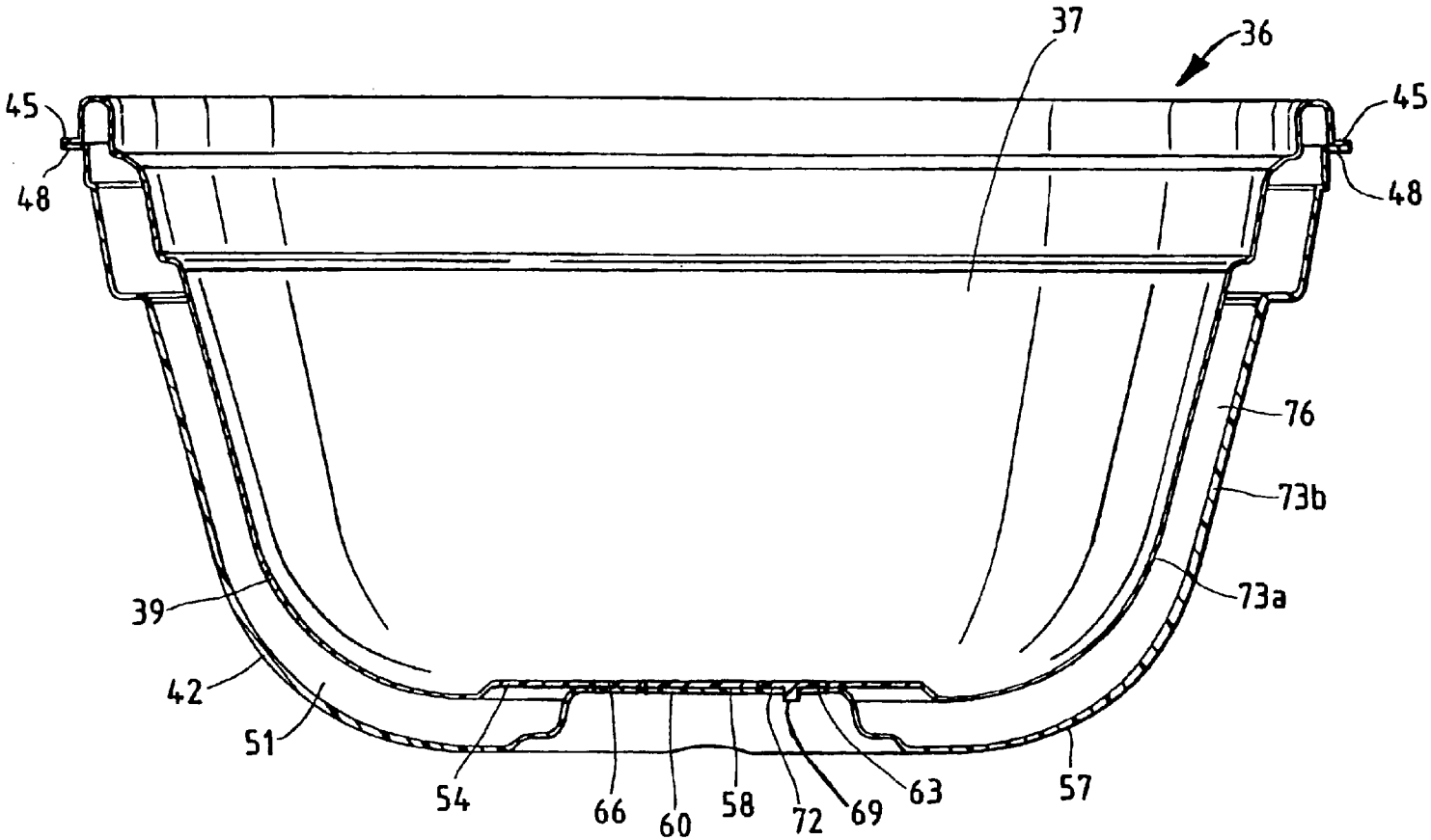
FIG. 4A is a sectional view taken generally along the lines 4A—4A of FIG. 2.

Referring now to FIG. 1, a container 36 defines an interior space 37 for placement of products therein. Referring also to FIG. 4A, the container 36 includes a first container portion 39 and a second container portion 42. The container portions 39 and 42 are constructed of polypropylene but other suitable materials may be employed. The first container portion 39 includes a first rim 45. The second container portion 42 includes a second rim 48 wherein the second rim 48 is joined to the first rim 45, thereby defining a sealed cavity 51 between the container portions 39 and 42. The rims 45 and 48 may be joined by any suitable means including ultrasonic welding, spin welding, hot plate welding or by use of an adhesive, but the portions 39 and 42 are preferably joined by vibration welding. Alternatively, the portions 39 and 42 could be joined in a mechanical fashion (not shown), such as by press fitting or interfitting, such that the portions 39 and 42 are substantially sealed to define the cavity 51. A coolant (not shown) is placed within the sealed cavity 51. The first container portion 39 includes a first base portion 54, and the second container portion 42 includes a second base portion 57. A pressure relief apparatus 58 comprises a joined section 60 (seen also in FIG. 2) that joins the first base portion 54 to the second base portion 57 at first and second connection regions 63 and 66.

Any suitable coolant may be disposed within the cavity 51, but preferably the coolant is a cross-linked gel having a generally solid structure such that if the gel were heated the gel matrix tends to remain intact allowing only water vapor to escape from the gel matrix. In operation, the container 36 is first placed in a freezer for a long enough time to freeze the gel. Thereafter, a user may take the container 36 out of the freezer and place products within the interior space 37. The frozen gel should maintain food or other perishable items placed within the interior space 37 of the container 36 within a temperature range between about 10° C. to about 15.5° C. for about four to about six hours in a room temperature environment. In an above room temperature environment, the time and temperature ranges are affected somewhat depending on the ambient temperature. A preferred formulation of the gel comprises a mixture of about 98.2% water and a polymer of about 1.8% to about 2.1% solids. The solids include about 80–85% sodium carboxymethylcellulose, roughly 10–16% sodium benzoate and about 4–6% cross-linkers. The gel is available from Progressive Polymer Application of Sheridan, Wyoming and is sold under the trade name UNIGEL. A small amount of paraben (an anti-microbial preservative) is added to the gel as an additional component of the preferred gel formulation. Of course, other suitable gel formulations may be employed. It should be noted that the container 36 is not limited to use with only perishable food products. Rather, many other products may be kept cool by placement within the container 36. For example, human organs intended for transplant surgery may be placed temporarily therein. Alternatively, a cosmetic product, beverage or chemical compound may be placed in the container 36.

Figure 3:
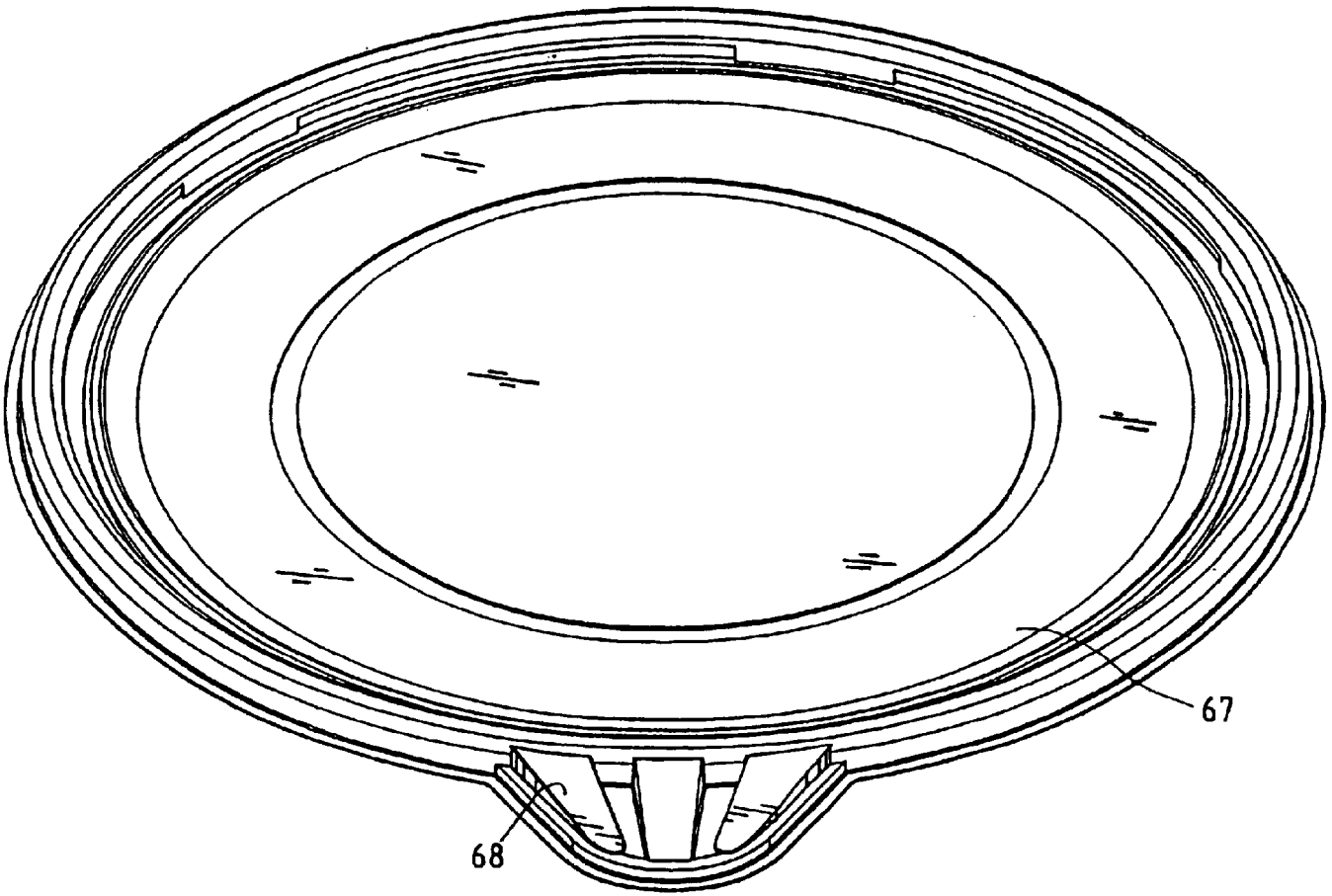
FIG. 3 is an isometric view of a lid for use with the container of FIG. 1 looking down from above.

FIG. 3 illustrates a lid 67 that may be used to seal contents placed within the container 36 in an airtight manner. The lid 67 includes a grasping tab 68 to facilitate removal of the lid 67.

Assembly of the container 36 includes the following steps. The components of the gel are mixed together at room temperature. While still in a liquid state, the gel is poured into the second container portion 42. The first container portion 39 is placed within the second container portion 42, thereby displacing the gel upwardly along the walls of the portions 39 and 42 defining the cavity 51. Within several hours, the gel cures such that it assumes a generally solid structure. Thereafter or before curing of the gel, the joined section 60 is vibration welded to join the base portions 54 and 57. Simultaneously, the rims 45 and 48 are also joined together by vibration welding to seal the cavity 51. However, the respective steps of welding the portions 54 and 57 and of welding the rims 45 and 48 could be performed sequentially.

Figure 4B:
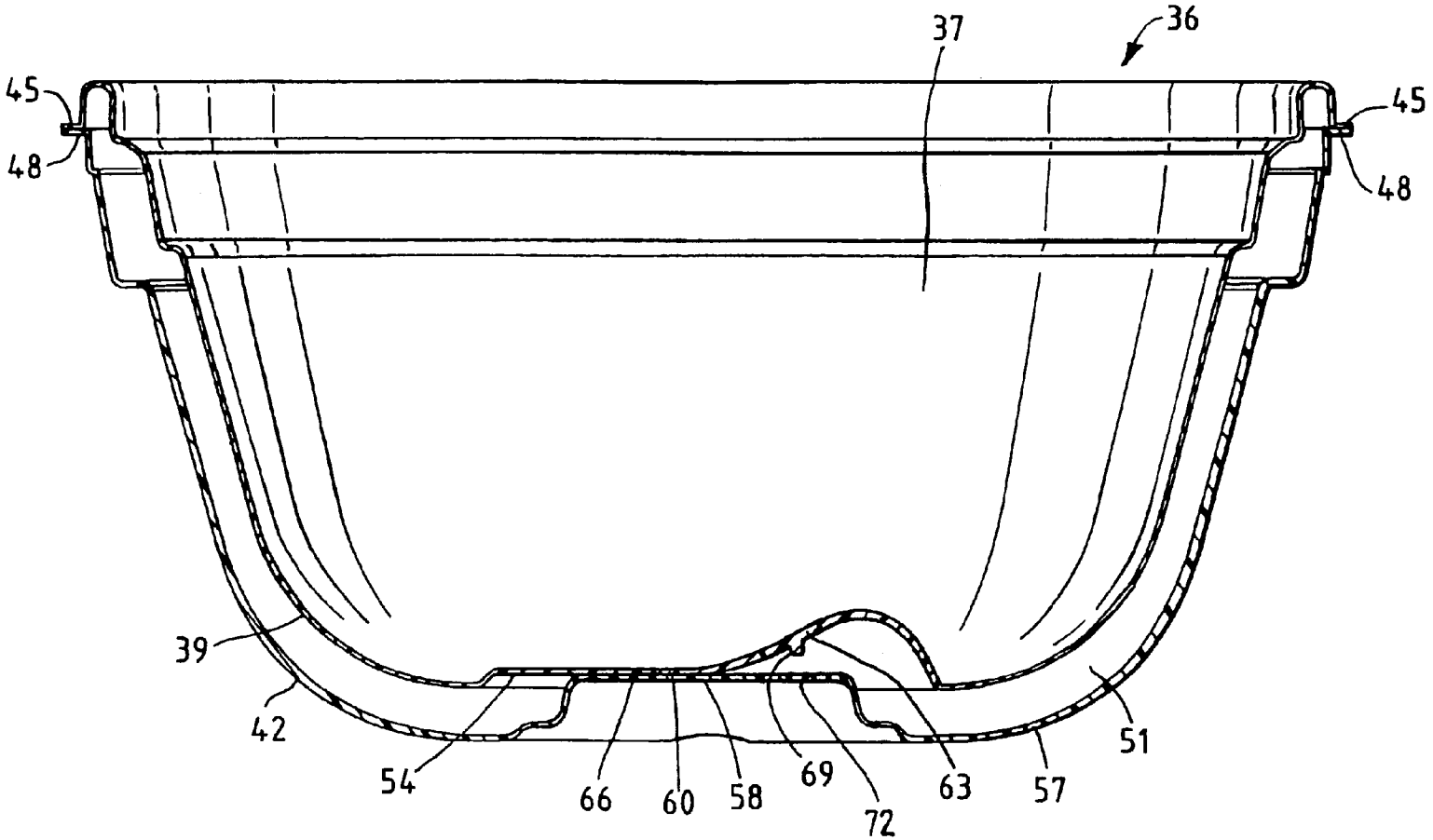
FIG. 4B is a sectional view similar to FIG. 4A illustrating rupture of a first connection region.

Referring to FIGS. 4A and 4B, the first connection region 63 includes a projection portion 69 integral with the first container portion 39. The projection portion 69 is vibration welded within an opening 72 of the second container portion 42. The opening 72 is preferably about ⅛ inch in diameter. The first connection region 63 is rupturable upon exposure to elevated pressure within the sealed cavity 51. The elevated pressure may result from heating the gel and/or container 36 such as by placement in a microwave oven. Heat developed within the sealed cavity 51 elevates pressure within the sealed cavity 51 forcing the walls of the first and second container portions 39 and 42 to push away from one another. When sufficient elevated pressure is reached, the walls of the first and second container portions 39 and 42 push away from one another with sufficient force to cause separation (rupture) of the first connection region 63. During separation, the base portion 54 carries the projection portion 69 upwardly away from the base portion 57, thereby removing the projection portion 69 out of the opening 72 and exposing the cavity 51 to the opening 72 as illustrated in FIG. 4B. Exposure of the opening 72 allows steam from the heated gel (or other heated coolant in vapor and/or solid form) to escape from the cavity 51. This prevents the walls of the container 36 from rupturing.

Figure 5:
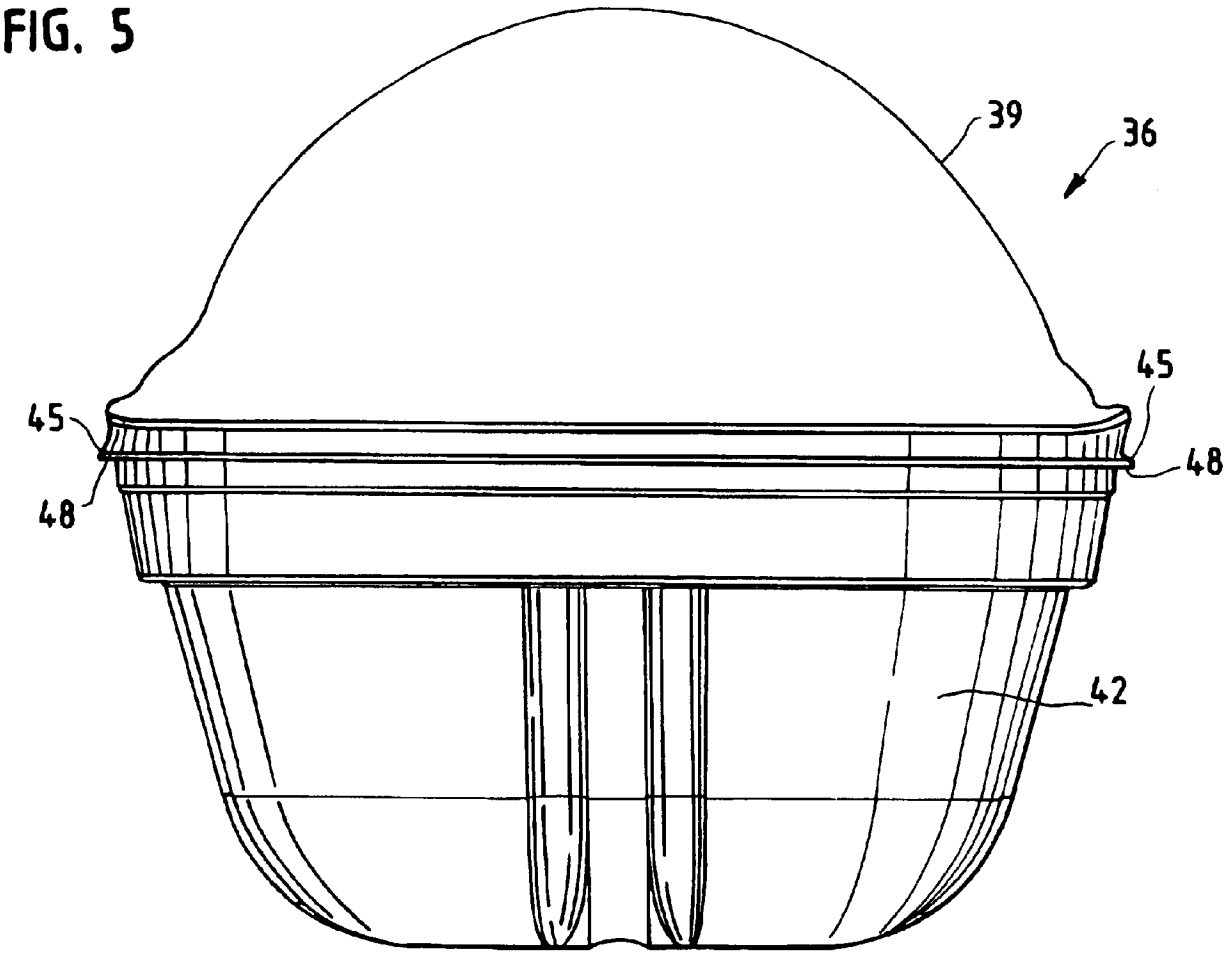
FIG. 5 is a front elevational view of a container which does not include a second connection region.

It should be noted that the joined section 60 could alternatively join side portions 73*a* and 73*b* (FIG. 4A) of the respective first and second container portions 39 and 42 together. However, the joined section 60 preferably joins the base portions 54 and 57. The opening 72 could also be disposed in the first container portion 39. However, the opening is preferably disposed in the second container portion 42 to prevent contamination of product placed within the interior space 37 of the container 36 by the heated gel. The second connection region 66 joins the first and second container portions 39 and 42 together more securely than the first connection region 63 such that when an elevated pressure is reached within the cavity 51, the first connection region 63 ruptures exposing the opening 72 while the second connection region 66 remains intact. The connection region 66 thus prevents possible inversion of the container portion 39, for example as illustrated in FIG. 5. In this regard, once the first connection region 63 ruptures, the cavity 51 is no longer sealed and it is not possible for sufficient pressure to develop within the unsealed cavity to cause rupture of the second connection region 66.

As described above, the first connection region 63 ruptures in response to elevated pressure to limit pressure in the sealed cavity 51. However, the region 63 could be replaced with a region that alternatively limits elevated pressure by rupturing in response to a different parameter, such as an elevated temperature. By way of example only, a region could be employed that melts below the boiling point of the coolant within the cavity 51. Melting of the region exposes the cavity 51 to the ambient surroundings so that pressure in the cavity 51 is limited. For example, the projection portion 69 might be constructed of a material having such a relatively low melting point that the portion 69 melts in response to such temperature, thereby exposing the opening 72 to the cavity 51. Alternatively, the portion 69 might consist of a material that splinters or cracks in response to such temperature, thereby exposing the opening 72. In such a container, the second connection region 66 would not melt or otherwise rupture in response to the elevated temperature, and as in other embodiments described herein, would prevent possible inversion illustrated in FIG. 5.

Figure 6A:
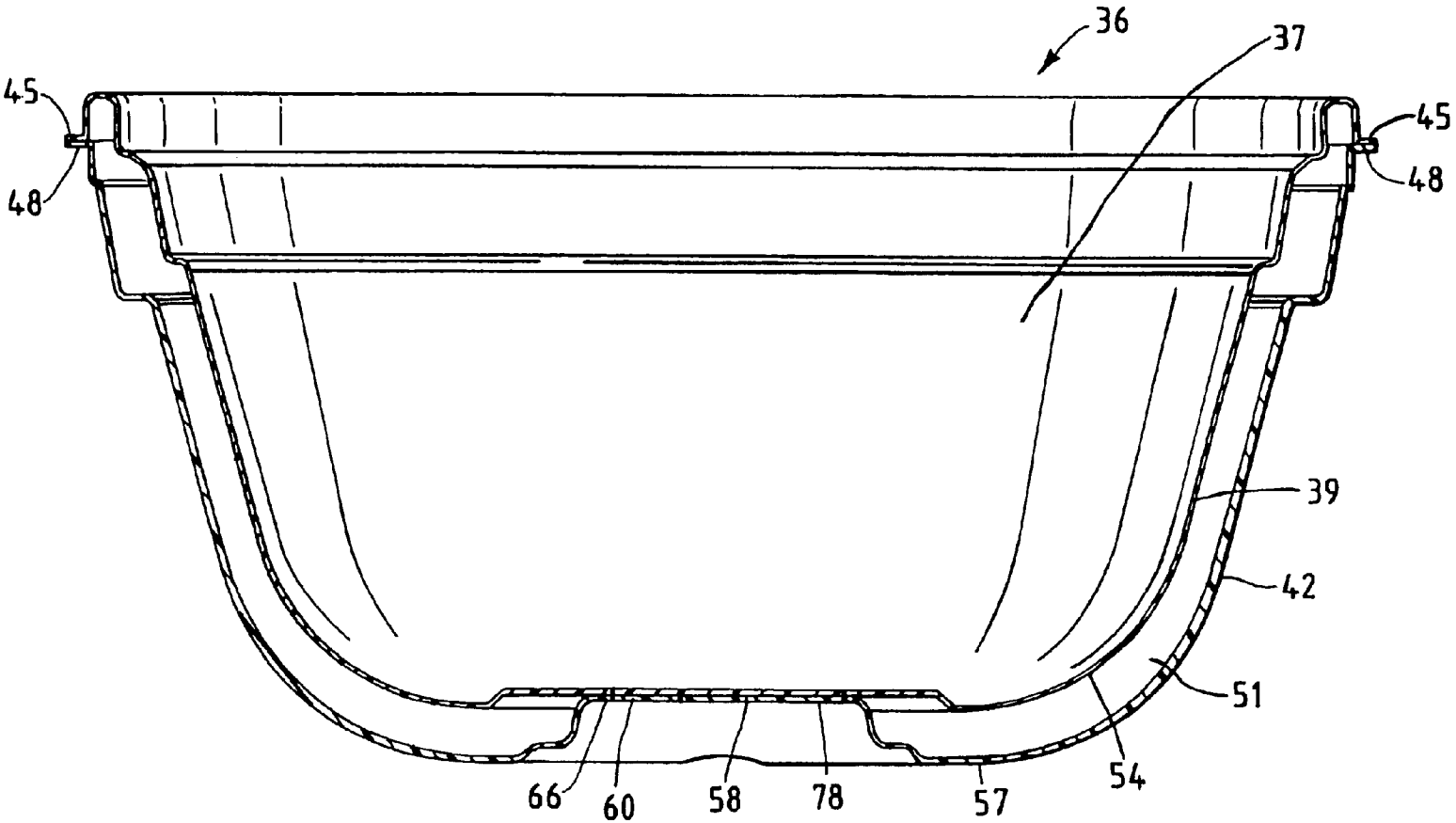
FIG. 6A is a sectional view similar to FIG. 4A of a second embodiment of a container illustrating a tear-away weld as the pressure relief apparatus.
Figure 6B:
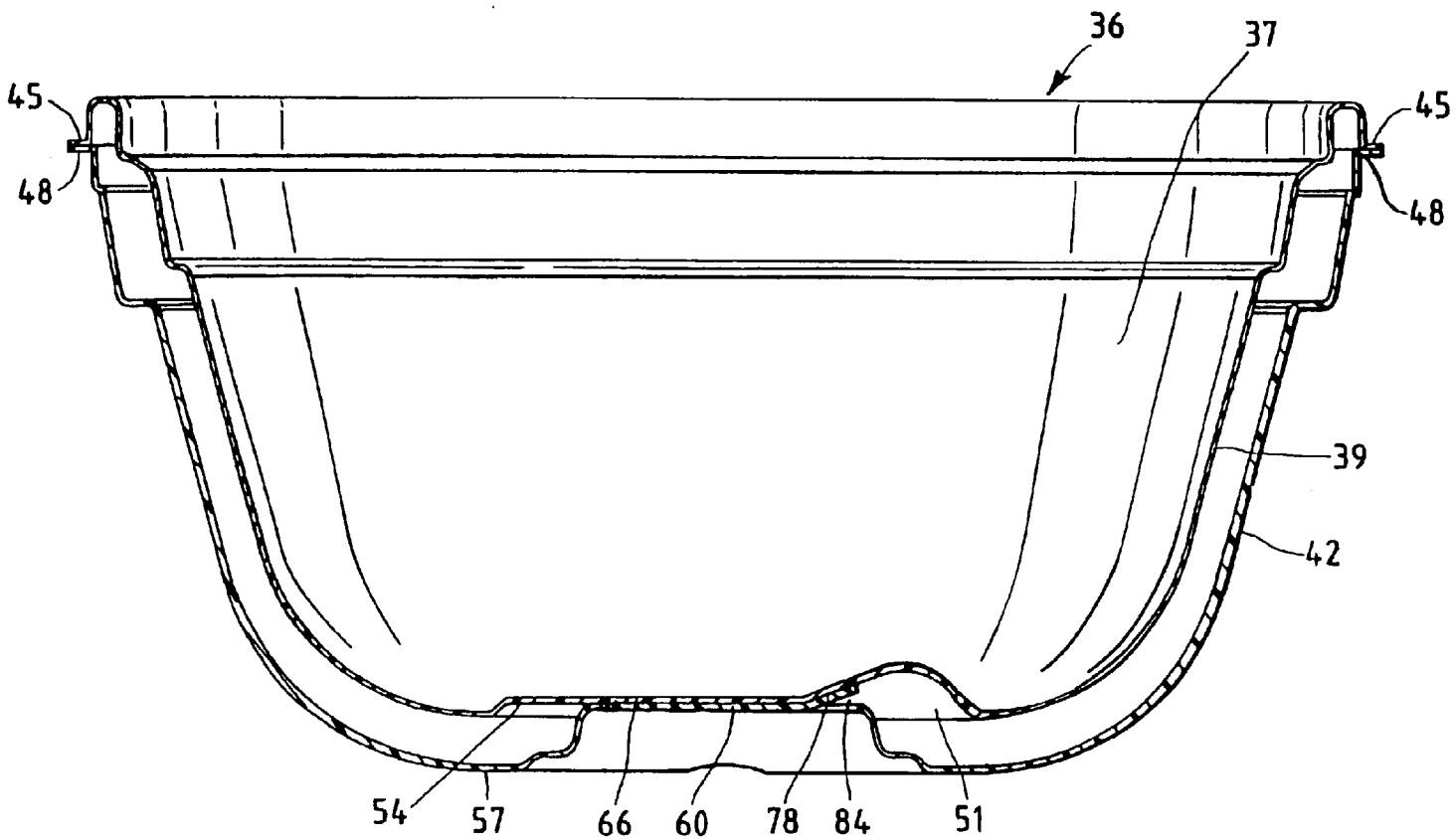
FIG. 6B is a sectional view similar to FIG. 4A illustrating rupture of the tear-away weld of the container of FIG. 6A.

FIGS. 6A and 6B illustrate a second embodiment wherein elements common to the various embodiments are given like reference numerals. The first connection region 63 is replaced by a tear-away weld 78 connecting the base portions 54 and 57 adjacent the connection region 66. Upon exposure to an elevated pressure, the base portion 54 separates from the base portion 57 such that the portion 54 tears away a part of the portion 57 welded thereto (at the weld 78) to create an opening 84 (seen in FIG. 6B). The newly created opening 84 exposes the cavity 51, thereby preventing undesirable pressure build-up therein. As discussed above, the assembly of the container 36 includes the step of first filling the container portion 42 with gel while the gel is still in a pourable, liquid state. In the first embodiment illustrated in FIGS. 4A and 4B, pouring the liquid gel into the container portion 42 might result in some spilling or leakage of the gel through the opening 72 in the second container portion 42. The embodiment illustrated in FIGS. 6A and 6B overcomes this problem by employing the tear-away weld 78 that does not require a pre-existing opening (like the opening 72) in the container portion 42. It should be noted that the weld 78 could alternatively create several smaller openings or perforations (not shown) in the base portion 57 rather than the single opening 84.

Figure 7:
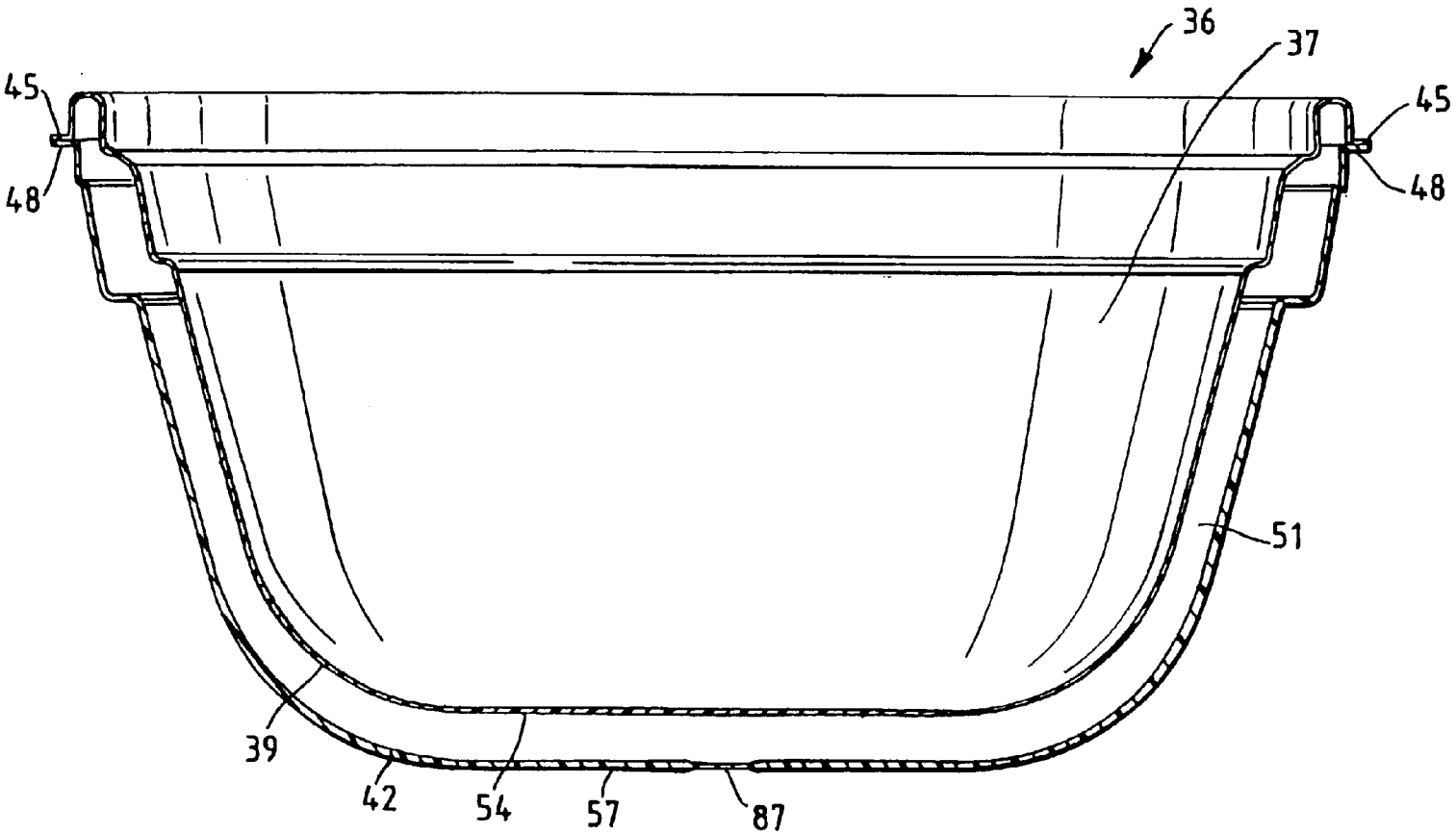
FIG. 7 is an enlarged sectional view similar to FIG. 4A of a third embodiment of a container illustrating a thinned wall portion as the pressure relief apparatus.

FIG. 7 illustrates a third embodiment wherein the joined section 60 is replaced by a thinned wall portion 87 preferably disposed in the base portion 57 of the second container portion 42. Exposure to an elevated pressure in the cavity 51 causes the portion 87 to rupture. A connection region (not shown) identical to the connection region 66 could be disposed near the portion 87 in this or any of the following embodiments discussed hereinafter.

Figure 8:
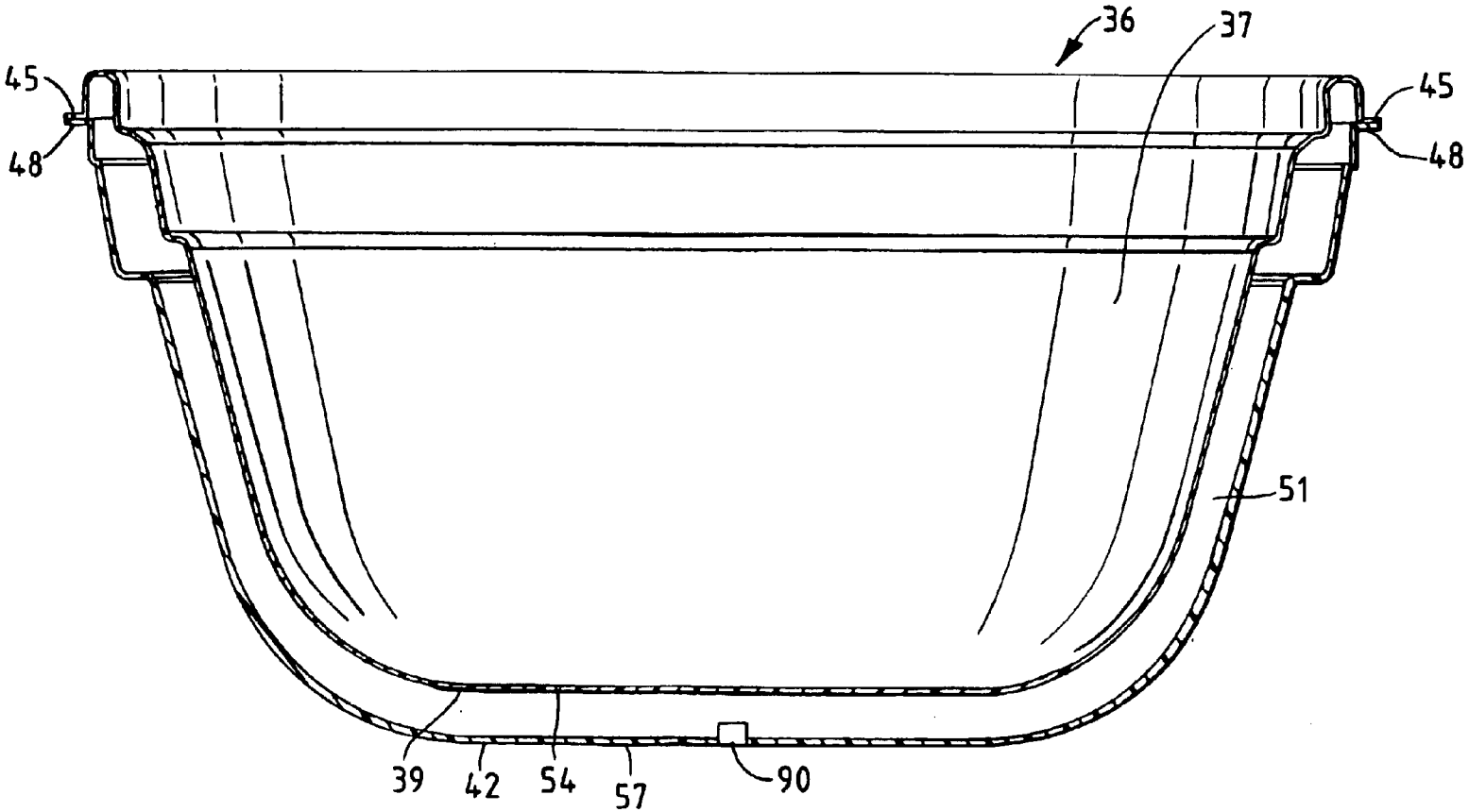
FIG. 8 is a sectional view similar to FIG. 4A of a fourth embodiment of a container illustrating a valve as the pressure relief apparatus.

FIG. 8 illustrates a fourth embodiment wherein the joined section 60 is replaced by a valve 90 that opens in response to an elevated pressure in the cavity 51 to limit pressure in the cavity 51.

Figure 9:
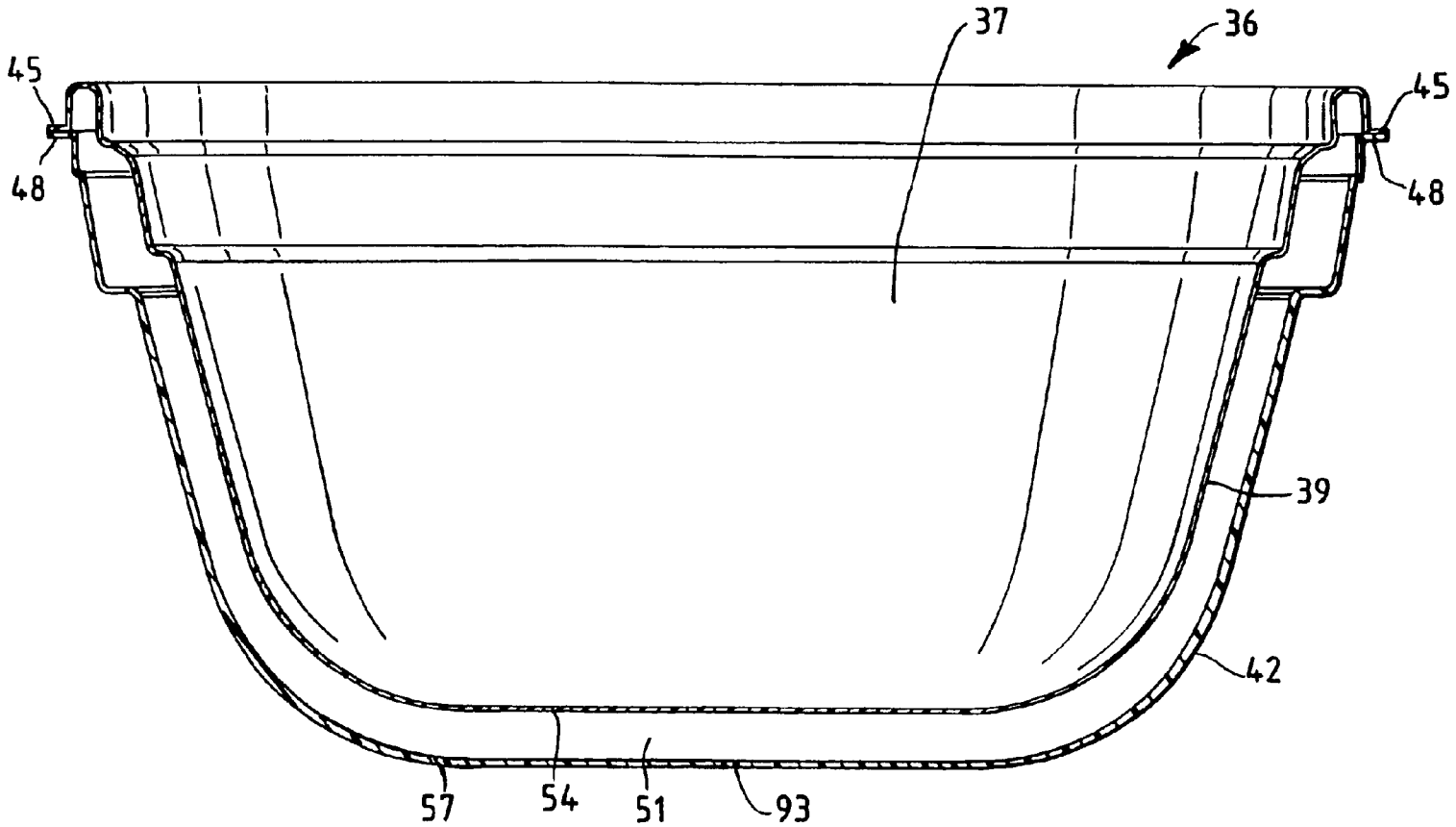
FIG. 9 is an enlarged full sectional view of a fifth embodiment illustrating an opening as the pressure relief apparatus.

FIG. 9 illustrates a fifth embodiment wherein the joined section 60 is replaced by a small opening 93 disposed in one of the container portions 39 or 42 (but preferably in the base portion 57 of the container portion 42) which prevents pressure rise beyond a certain level. A resilient plug (not shown) made of rubber or other suitable material could be disposed within the opening 93 to prevent contaminants from entering the cavity 51. Such a plug would eject from the opening in response to an elevated pressure in the cavity 51.

Figure 10:
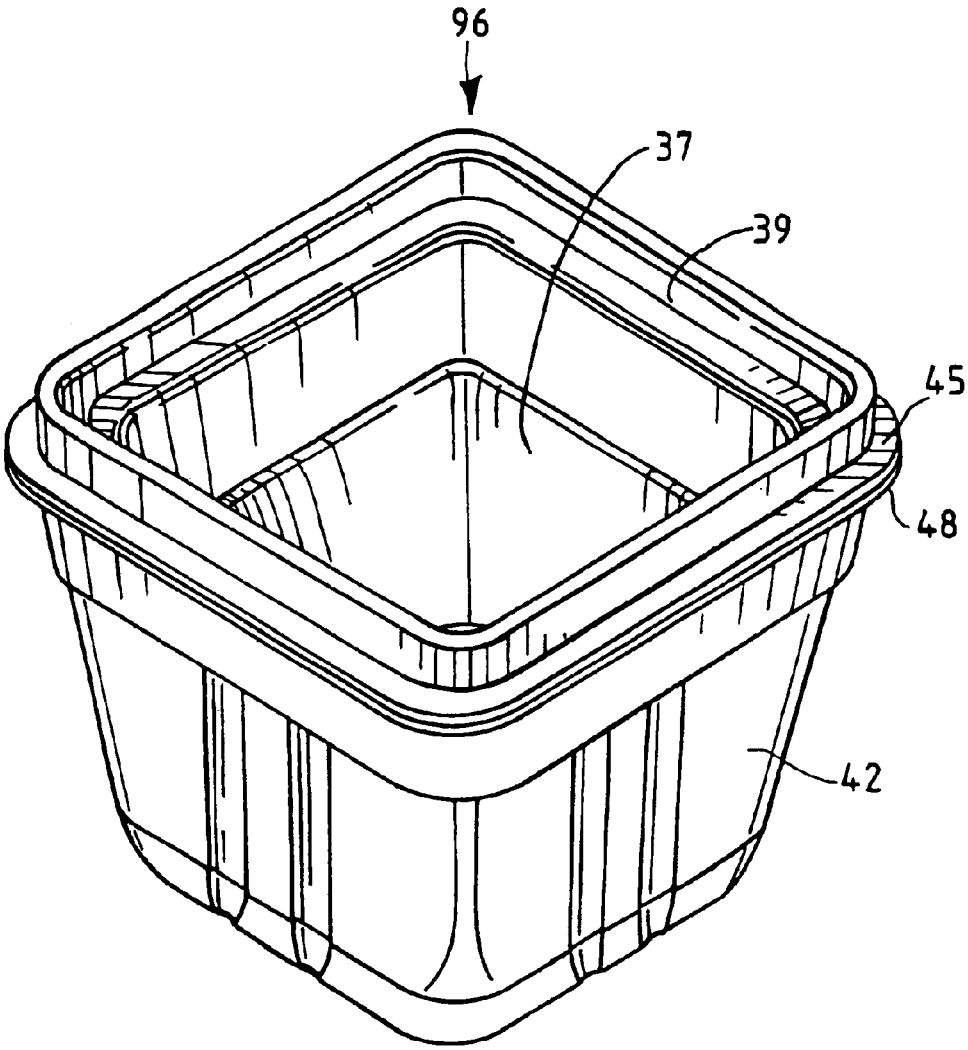
FIG. 10 is an isometric view of a sixth embodiment of a container illustrating a different shape of container looking down from above.

FIG. 10 illustrates a sixth embodiment of a square container 96 that incorporates pressure relief apparatus, but which differs from the container 36 in shape. A lid (not shown) of suitable dimension could be placed on the container to seal products placed within the interior space 37. It should be evident from the container 96 of FIG. 10 that many variations of geometric shape and dimension are possible for a container incorporating any of the pressure relief apparatuses illustrated in FIGS. 4A and 4B and FIGS. 6–9.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A container, comprising:

a first container portion joined to a second container portion to define a cavity therebetween;

a coolant disposed within the cavity;

an opening defined by the second container portion; and a projection carried by the first container portion and disposed within the opening such that the cavity is sealed;

wherein a pressure increase within the cavity moves the container portions apart thereby withdrawing the projection from the opening to unseal the cavity and vent the pressure increase.

2. The container of claim 1, wherein the pressure relief apparatus comprises a joined section that joins the first and second container portions and movement of the first container portion relative to the second container portion ruptures the joined section.

3. A container, comprising:

a first container portion;

a second container portion joined to the first container portion to define a sealed cavity therebetween;

a coolant disposed within the cavity; and pressure relief apparatus operable to vent a pressure increase in the sealed cavity to ambient surroundings wherein one of the container portions is movable relative to the other of the container portions in response to the pressure increase to create a passage to vent the pressure increase;

wherein the pressure relief apparatus comprises a joined section that joins the first and second container portions and movement of the first container portion relative to the second container portion ruptures the joined section and creates the passage;

wherein the joined section includes a first connection region that ruptures at a first pressure and a second connection region that ruptures at a second pressure greater than the first pressure.

4. The container of claim 2, wherein the joined section ruptures in response to an elevated temperature in the sealed cavity to limit pressure in the cavity.

5. A container, comprising:

a first container portion;

a second container portion joined to the first container portion to define a sealed cavity therebetween;

a coolant disposed within the cavity; and pressure relief apparatus operable to vent a pressure increase in the sealed cavity to ambient surroundings wherein one of the container portions is movable relative to the other of the container portions in response to the pressure increase to create a passage to vent the pressure increase;

wherein the pressure relief apparatus comprises a joined section that joins the first and second container portions and movement of the first container portion relative to the second container portion ruptures the joined section and creates the passage;

wherein the joined section ruptures in response to an elevated temperature in the sealed cavity to limit pressure in the cavity;

wherein the elevated temperature comprises a first elevated temperature and wherein the joined section includes a first connection region that ruptures at the first elevated temperature and the joined section further includes a second connection region that is rupturable at a second elevated temperature greater than the first elevated temperature.

6. The container of claim 1, wherein the coolant comprises a cross-linked gel.

7. The container of claim 6, wherein the gel includes carboxymethylcellulose.

8. The container of claim 7, wherein the gel includes a preservative.

9. The container of claim 1, wherein the container is exposed to room temperature and wherein the container is capable of maintaining items placed therein within a range of temperatures below room temperature for a period of time.

10. The container of claim 9, wherein the range of temperatures is about 10° C. to about 5.50° C. and wherein the period of time is about 4 to about 6 hours.

11. A container, comprising:

a first container portion defining an interior space for placement of product therein;

a second container portion permanently joined to the first container portion at rims of the container portions to define a sealed cavity extending from the rims toward a base of the container;

a coolant disposed within the cavity; and pressure relief apparatus operable to vent a pressure increase in the sealed cavity to ambient surroundings comprising a joined section spaced from the rims of the container portions that joins the first and second container portions and wherein the joined section ruptures in response to the pressure increase in the sealed cavity to limit pressure in the cavity.

12. A container, comprising:

a first container portion;

a second container portion joined to the first container portion to define a sealed cavity therebetween;

a coolant disposed within the cavity; and pressure relief apparatus operable to vent a pressure increase in the sealed cavity to ambient surroundings comprising a joined section that joins the first and second container portions and wherein the joined section ruptures in response to the pressure increase in the sealed cavity to limit pressure in the cavity;

wherein the joined section includes a first connection region that ruptures at a first pressure and a second connection region that ruptures at a second pressure greater than the first pressure.

13. A container, comprising:

a first container portion;

a second container portion permanently joined to the first container portion to define a sealed cavity therebetween;

a coolant disposed within the cavity; and pressure relief apparatus operable to vent a pressure increase in the sealed cavity to ambient surroundings comprising a joined section that joins the first and second container portions and wherein the joined section ruptures in response to the pressure increase in the sealed cavity to limit pressure in the cavity;

wherein the joined section ruptures in response to an elevated temperature in the sealed cavity to limit pressure in the cavity.

14. A container, comprising:

a first container portion;

a second container portion joined to the first container portion to define a sealed cavity therebetween;

a coolant disposed within the cavity; and pressure relief apparatus operable to vent a pressure increase in the sealed cavity to ambient surroundings comprising a joined section that joins the first and second container portions and wherein the joined section ruptures in response to the pressure increase in the sealed cavity to limit pressure in the cavity;

wherein the joined section ruptures in response to an elevated temperature in the sealed cavity to limit pressure in the cavity;

wherein the elevated temperature comprises a first elevated temperature and wherein the joined section includes a first connection region that ruptures at the first elevated temperature and the joined section further includes a second connection region that ruptures at a second elevated temperature greater than the first elevated temperature.

15. A container, comprising:

a first container portion;

a second container portion permanently joined to the first container portion to define a sealed cavity therebetween;

a coolant disposed within the cavity; and pressure relief apparatus operable to vent a pressure increase in the sealed cavity to ambient surroundings comprising a joined section that joins the first and second container portions and wherein the joined section ruptures in response to the pressure increase in the sealed cavity to limit pressure in the cavity;

wherein the coolant comprises a cross-linked gel.

16. The container of claim 15, wherein the gel includes carboxymethylcellulose.

17. The container of claim 15, wherein the gel includes a preservative.

18. A container, comprising:

a first container portion;

a second container portion permanently joined to the first container portion to define a sealed cavity therebetween;

a coolant disposed within the cavity; and pressure relief apparatus operable to vent a pressure increase in the sealed cavity to ambient surroundings comprising a joined section that joins the first and second container portions and wherein the joined section ruptures in response to the pressure increase in the sealed cavity to limit pressure in the cavity;

wherein the container is exposed to room temperature and wherein the container is capable of maintaining items placed therein within a range of temperatures below room temperature for a period of time.

19. The container of claim 18, wherein the range of temperatures is about 10° C. to about 15.5° C. and wherein the period of time is about 4 to about 6 hours.

20. A container, comprising:

a first container portion;

a second container portion joined to the first container portion to define a sealed cavity therebetween;

a coolant disposed within the cavity; and a joined section that joins the first and second container portions wherein the joined section ruptures in response to an elevated pressure in the sealed cavity to limit pressure in the cavity, the joined section including a first connection region that ruptures at a first pressure and a second connection region that is rupturable at a second pressure greater than the first pressure.

21. The container of claim 20, wherein the joined section ruptures in response to an elevated temperature to limit pressure within the cavity.

22. The container of claim 21, wherein the rupture results from mechanical stress caused by the elevated temperature.

23. The container of claim 22, wherein the mechanical stress includes cracking of the joined section.

24. The container of claim 21, wherein rupture results from melting of the joined section caused by the elevated temperature.

25. The container of claim 20, wherein the coolant comprises a cross-linked gel.

26. The container of claim 25, wherein the gel includes carboxymethylcellulose.

27. A container, comprising:

an inner container portion;

an outer container portion permanently joined to the inner container portion to define a sealed cavity therebetween;

a coolant disposed within the cavity; wherein the coolant comprises a cross-linked gel, and pressure relief apparatus operable to vent a pressure increase in the sealed cavity to ambient surroundings wherein the pressure relief apparatus comprises only an unobstructed opening in the outer container portion.

28. The container of claim 27, wherein the gel includes carboxymethylcellulose.

29. A container, comprising:

a first container portion;

a second container portion joined to the first container portion to define a sealed cavity therebetween;

a coolant disposed within the cavity; and a joined section that joins the first and second container portions wherein the joined section is operable to limit pressure within the cavity;

the first container portion further comprising a first wall having a base portion and a first rim and wherein the second container portion comprises a second wall having a second rim and wherein the second rim is joined to the first rim; and the second wall further comprising a first raised portion joined to the base portion that is rupturable in response to a first elevated pressure and a second raised portion joined to the base portion that is rupturable at a second elevated pressure greater than the first elevated pressure.

30. The container of claim 29, wherein the coolant comprises a carboxymethylcellulose cross-linked gel.

31. A container, comprising:

a first container portion having a first wall, a base portion and a first rim;

a second container portion having a second wall and a second rim wherein the second rim is joined to the first rim, thereby defining a cavity between the container portions;

a coolant disposed within the cavity;

a first raised portion integral with the second wall wherein the first raised portion joins the second wall to the base portion and is rupturable in response to a first elevated pressure; and a second raised portion integral with the second wall wherein the second raised portion joins the second wall to the base portion and is rupturable at a second elevated pressure greater than the first elevated pressure.

32. The container of claim 31, wherein the coolant comprises a carboxymethylcellulose cross-linked gel.

* * * * *

UNITED STATES PATENT AND TRADEMARK OFFICE

CERTIFICATE OF CORRECTION

PATENT NO. : 6,923,017 B2
APPLICATION NO. : 10/073559
DATED : August 2, 2005
INVENTOR(S) : Brian C. Dais et al.

It is certified that error appears in the above-identified patent and that said Letters Patent is hereby corrected as shown below:

Column 6: Line 66, replace “5.50° C” with --15.5° C--

Signed and Sealed this

Twenty-ninth Day of July, 2008

JON W. DUDAS
*Director of the United States Patent and Trademark Office*